US005296006A

United States Patent [19]

Reed et al.

[11] Patent Number: 5,296,006

[45] Date of Patent: Mar. 22, 1994

[54] 3-ACRYLAMIDO-3-METHYLBUTANOIC ACID COPOLYMERS AS SELECTIVE COAL FLOCCULANTS

[75] Inventors: Peter E. Reed, Naperville; Ram-Aiyangar Venkatadri, Chicago; Lawrence J. Connelly, Oak Lawn, all of Ill.

[73] Assignee: Nalco Chemical Company, Naperville, Ill.

[21] Appl. No.: 979,021

[22] Filed: Nov. 20, 1992

[51] Int. Cl.[5] ..... C10L 5/00; C10L 1/22; B03D 3/06

[52] U.S. Cl. ..... 44/621; 209/5; 210/734

[58] Field of Search ..... 44/621, 391, 394; 210/734; 209/4, 5

[56] References Cited

U.S. PATENT DOCUMENTS

| | | | |
|---|---|---|---|
| 3,624,019 | 11/1971 | Anderson | 252/363.5 |
| 4,342,653 | 8/1982 | Halverson | 210/734 |
| 4,555,329 | 11/1985 | Sykes et al. | 209/5 |
| 4,584,358 | 4/1986 | McCormick et al. | 526/240 |
| 4,816,166 | 3/1989 | Cawiezel | 210/734 |
| 4,943,378 | 7/1990 | Flesher et al. | 210/732 |

*Primary Examiner*—Margaret Medley
*Attorney, Agent, or Firm*—Robert A. Miller; John G. Premo

[57] ABSTRACT

3-acrylamido-3-methylbutanoic acid copolymers of acrylamide or acrylic acid are selective flocculant for coal present in coal refuse slurries.

4 Claims, 2 Drawing Sheets

3-ACRYLAMIDO-3-METHYLBUTANOIC ACID COPOLYMERS AS SELECTIVE COAL FLOCCULANTS

FIELD OF THE INVENTION

The invention relates to the selective flocculation of coal which is present in coal refuse slurries.

BACKGROUND OF THE INVENTION

Introduction

Typical coal refuse thickener feed to a settling tank contains considerable amounts of inorganic gangue, clays and the like. These materials have previously been pulverized and dispersed in water and present a difficult problem in regards to the recovery of coal values therefrom. In most instances, no attempt is even made to recover the coal in the refuse or reject. As a result, the coal is lost. The coal content in the refuse can range from 25 to 70% (based on the weight of refuse solids). Simply adding flocculants to this slurry provides flocculation for both coal particulate matter as well as particulate matter obtained from inorganic gangue, clays and other suspended materials present in these slurries, such that separation of the coal values is not possible.

If it would be possible to selectively flocculate the coal from such a pulverized coal refuse slurry, an advance in the art could be achieved.

We have discovered that we can selectively flocculate the coal from such a pulverized coal refuse aqueous slurry by the use of special flocculants which then cause the selective flocculation and settling of coal particles while leaving inorganic gangue, clays and like materials preferentially suspended in the aqueous phase.

Applying standard solid/liquid separation techniques in this selectively flocculated coal then provides for the recovery of a concentrated, flocculated coal slurry whose ash value is appreciable lower than the original coal refuse ash value and provides for the recovery of dispersed clays, inorganic gangues, and the like with recycle of waters possible which may derive additional economic benefit to the operator.

It is the object of this invention to selectively flocculate coal values from a dispersed pulverized coal refuse slurry which contains pulverized coal and inorganic gangue, clays and the like. A clay like inorganic gangue material dispersed in water may then be subsequently settled and collected, and the water values recycled back to the mining operations.

It is also an object of this invention to recover a low ash particulate coal from a pulverized coal refuse slurry containing high ash inorganic gangues, clays and the like.

THE DRAWINGS

Figure 1:
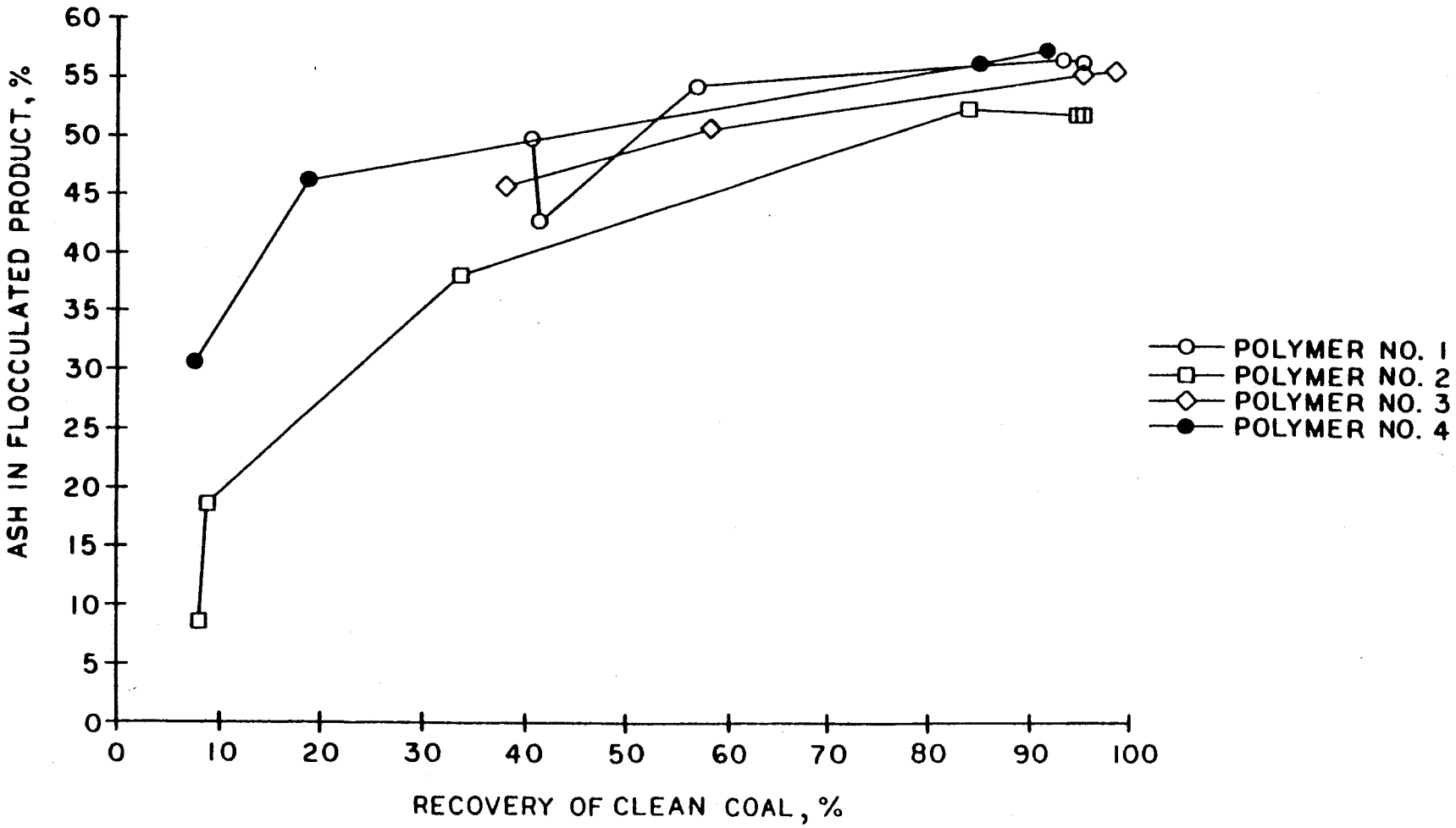
Figure 2:
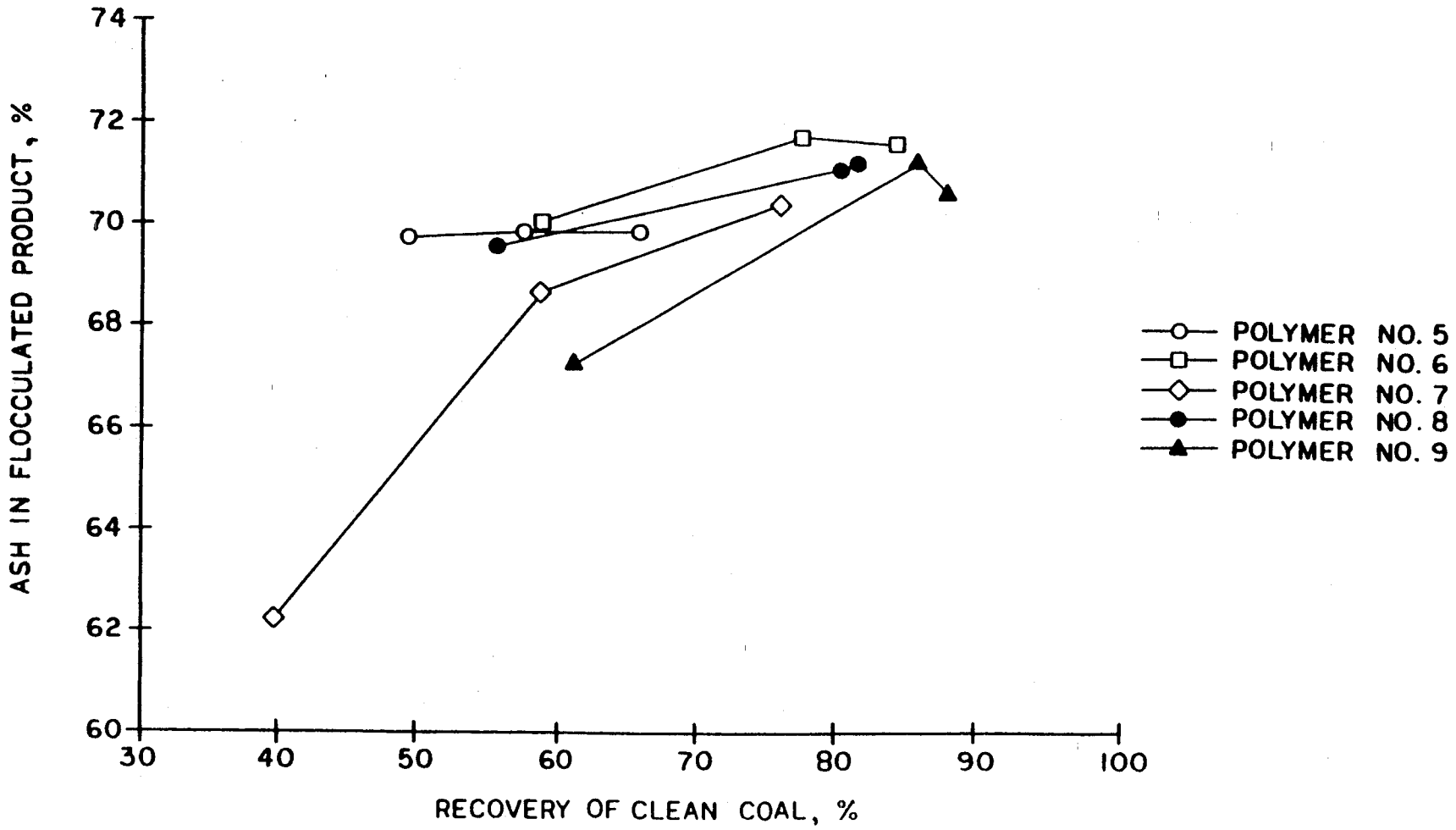

FIGS. 1 and 2 show the activity of the 3-acrylamido-3-methylbutanoic acid copolymers used in the invention as compared with several commercial coal refuse slurries flocculants.

THE INVENTION

The invention is directed to a process of the type where a water soluble polymeric flocculant is used to separate gangue from the coal present in a coal refuse slurry. Specifically, the invention is an improvement which comprises using as the flocculent a copolymer containing from 1–40 mole percent of 3-acrylamido-3-methybutanoic acid, AMBA, with either acrylamide or acrylic acid, which copolymer has an RSV of at least 15.

THE AMBA COPOLYMERS

Polymers of this type have been described in the literature. They are readily prepared using the preparative techniques set forth in U.S. Pat. No. 4,584,358 the disclosure of which is incorporated herein by reference. As indicated, the copolymers used in the practice of the invention are either AMBA acrylamide copolymers or acrylic acid copolymers. The AMBA copolymers may be modified with up to as much as 40 mole percent of hydrophobic monomers, which makes the copolymers more selective to the coal particles. Such comonomers would include acrylonitrile, vinyl acetate and the like. A preferred species of such monomers are the N-alkyl substituted acrylamides, such as dimethylacrylamide which may be present in amounts ranging between 5–50 mole percent.

It is understood that while the AMBA copolymers are named with respect to the acid form of AMBA, they are most commonly used in the form of a water soluble alkali metal, amine or ammonium salt. The alkali metal salts are preferred, with the sodium salt being most preferred.

MOLE PERCENT OF AMBA IN THE COPOLYMERS

Amounts as little as one mole percent up to as much as 40 mole percent of AMBA may be used to produce acrylamide or acrylic acid copolymers which are selective in the flocculation of coal from coal refuse slurries. It has been found that when the mole percent of the AMBA is between 10 and 30 mole percent the copolymers are quite selective towards coal particles. Higher mole percents tend to produce better results but these results are not proportional to the cost of the increased AMBA content of the copolymer.

THE REDUCED SPECIFIC VISCOSITY OF THE AMBA COPOLYMERS

The Reduced Specific Viscosity (RSV) of the AMBA copolymers should be at least 15 dl/g. Preferably, it should be at least 20. Usually, good results are achieved when the RSV is between 20 and 35. The RSV may be greater than 35, although such high molecular weight copolymers are not necessary to achieve good results in the practice of the invention.

The method used to determine RSV is as follows:

The AMBA copolymer, contained in a water in oil emulsion, is dissolved in an aqueous solution with the use of a hydrophilic surfactant. The basic technique used to invert the emulsion is described in U.S. Pat. No. 3,624,019, hereinafter incorporated by reference. The polymer solution is then diluted into a sodium nitrate solution so that the final concentrations of polymer and sodium nitrate are 0.045 wt. percent and 1.0M, respectively. The RSV of the resulting solution is then measured by the standard method using a Cannon-Ubbelohde viscometer.

DOSAGE OF AMBA COPOLYMERS

When used to treat the coal refuse slurries to selectively remove coal therefrom the AMBA copolymers are usually dosed, based on a water-in-oil emulsion containing about 30% active polymer, within a ppm of range of 0.1–50 ppm. Generally, good results are achieved when the dosage is between the range of 0.5 to 20 ppm. Lower or higher dosages may be used depending on the slurry treated. Routine experimentation can determine optimum dosage.

The AMBA copolymers of the invention may be used as a substitute for conventional coal slurry flocculants for treating coal refuse slurries. Such conventional flocculants are the high molecular weight flocculants prepared from acrylamide, acrylic acid, methacrylic acid, vinylsulfonic acid polymers, maleic anhydride and other similar monomers.

The AMBA Copolymers of the invention are particularly suited for providing the flocculant for use in the process described in U.S. Pat. No. 4,555,329, the disclosure of which is incorporated herein by reference. In this process, coal selectivity is improved by pretreating the slurry with an anionic ash dispersant.

A routine step in the treatment of coal refuse slurries after the flocculation which separates the gangue and the coal into two fractions requires that the dispersed clays and gangue materials be treated in a separate operation settled from the dispersed slurries by adding any kind of cationic flocculent and/or coagulant that may be available. This charge neutralizes the negative charge caused by the anionic dispersant absorbed on the surfaces of the inorganic clays ganges and the like materials in this gangue dispersion. The charge neutralization is often sufficient to cause settling to occur. It is immaterial whether or not a high molecular weight cationic flocculent or a cationic coagulant having a lower molecular weight is used in this step. The step may be optimized at the experimenter's choice.

EVALUATION OF THE INVENTION

To evaluate the invention to compare the AMBA copolymers as selective coal flocculants against other known coal flocculants a variety of polymers were evaluated. These polymers along with their RSV's are set forth in Table 1.

TABLE 1

Polymers Evaluated

| NO. | POLYMER | RSV |
|---|---|---|
| 1 | 30 mole % Acrylic Acid - Acrylamide | 33 |
| 2 | 30 mole % AMBA - Acrylamide | 36 |
| 3 | 30 mole % AMBA - Acrylamide | 22 |
| 4 | 10 mole % AMBA - Acrylamide | 25 |
| 5 | Polyacrylamide | 21 |
| 6 | 11 mole % AMPS* - Acrylamide | 19 |
| 7 | Polyacrylic Acid | 34 |
| 8 | 50 mole % Acrylic Acid - Acrylamide | 42 |
| 9 | 10 mole % AMBA - Acrylamide | 32 |
| 10 | 40 mole % Dimethyl Acrylamide - 30 mole % AMBA - 30 mole % Acrylamide | 22 |
| 11 | 35 mole % AMBA Acrylic Acid | 22 |

"*AMPS is a Trademark of Lubrizol Corporation and is 2-acrylamido-2-methylpropyl sulfonic acid."

The evaluation method generally corresponded with that described in U.S. Pat. No. 4,553,329. The results of these evaluations are set forth in Tables 2 and 3 and also in FIGS. 1 and 2. The meanings of the abbreviations used in the tables and figures are as follows:

| | |
|---|---|
| Set. Rt. | Settling rate |
| Turb. | Turbidity |
| Floc. Yld. | Wt. % of solids recovered in the flocculated material |
| A.I.F. | Wt. % ash present in the flocculated material |
| A.I.R. | Wt. % ash present in the refuse solids that did not flocculate |
| C.C.R. | Clean coal recovery; Floc. Yld. × (100 − A.I.F. / wt. % ash in feed slurry) |

The feed slurry used in Table 2 and FIG. 1 contained 1% solids comprised of 54.7% ash. The feed slurry used in Table 3 and FIG. 2 contained 3.1% solids comprised of 71.46% ash.

TABLE 2

| Polymer # | Dosage (ppm) | Set. Rt. (in/min) | Turb. NTU | Floc. Yld. (%) | A.I.F. (%) | A.I.R. (%) | C.C.R. (%) |
|---|---|---|---|---|---|---|---|
| 1 | 8 | 34 | 425 | 99 | 55.7 | — | 96.8 |
| | 4 | 33 | 300 | 98 | 56.2 | — | 94.7 |
| | 0.8 | 21 | 420 | 57 | 54.2 | 55.9 | 57.6 |
| | 0.4 | 20 | 595 | 21 | 49.3 | 56.4 | 23.5 |
| | 0.24 | 11 | 620 | 37 | 49.8 | 56.8 | 41 |
| | 0.12 | 10 | 660 | 33 | 42.7 | 57.5 | 41.7 |
| 2 | 8 | 12 | 1200 | 82 | 51.7 | 59 | 96.6 |
| | 4 | 10 | 1360 | 89 | 51.3 | 57.4 | 95.7 |
| | 0.8 | 11 | 1360 | 80 | 51.8 | 52.5 | 85.1 |
| | 0.4 | 11 | 1440 | 24 | 38.1 | 56.3 | 34 |
| | 0.24 | 5 | 1920 | 4 | 8.6 | 56.5 | 8.1 |
| | 0.12 | 5 | 2100 | 5 | 18.6 | 58.3 | 9 |
| 3 | 8 | 21 | 750 | 97 | 54.8 | | 96.8 |
| | 4 | 21 | 800 | 84 | 54.7 | 55.3 | 100 |
| | 0.8 | 11 | 1120 | 54 | 50.6 | 61.6 | 58.9 |
| | 0.4 | 12 | 1360 | 32 | 45.8 | 60.8 | 38.3 |
| 4 | 8 | 44 | 380 | 98 | 59.6 | | 93.2 |
| | 4 | 44 | 560 | 89 | 56 | 54.5 | 86.4 |
| | 0.8 | 11 | 1240 | 16 | 46.3 | 58.7 | 18.9 |
| | 0.4 | 10 | 1300 | 5 | 30.6 | 58.4 | 7.7 |

TABLE 3

| Polymer # | Dosage (ppm) | Set. Rt. (in/min) | Turb. NTU | Floc. Yld. (%) | A.I.F. (%) | A.I.R. (%) | C.C.R. (%) |
|---|---|---|---|---|---|---|---|
| 5 | 12 | 2.1 | — | 54 | 69.8 | 76.1 | 57.1 |
| | 10 | 2.1 | 1720 | 46.4 | 69.7 | 75.9 | 49.1 |
| | 6 | 2 | 2460 | 62.8 | 70.3 | 75.8 | 65.4 |
| 6 | 8 | 30 | 660 | 77.4 | 71.7 | 75.6 | 76.7 |
| | 4 | 12 | 860 | 83.2 | 71.4 | 75.7 | 83.4 |
| | 2 | | 2960 | 55.6 | 70 | 76.4 | 58.4 |
| 7 | 12 | 2.8 | 2640 | 72.5 | 70.4 | 76 | 75.3 |
| | 8 | 2.5 | 3440 | 52.9 | 68.6 | 76.3 | 58.2 |
| | 4 | 0.6 | 3720 | 30 | 62.2 | 75.9 | 39.8 |
| 8 | 4 | 15 | 580 | 78.8 | 71.1 | 75.5 | 70.7 |
| | 3 | 4.2 | 890 | 79.6 | 71.1 | 75.1 | 80.7 |
| | 2 | | 2480 | 51.8 | 69.5 | 74.9 | 55.3 |
| 9 | 8 | 40 | 500 | 84.3 | 71.3 | 74.4 | 84.8 |
| | 4 | 7 | 1640 | 83.1 | 70.1 | — | 87.1 |
| | .6 | 4 | 3240 | 53 | 67.2 | 75.1 | 60.9 |

Polymer #10 and #11 when evaluated would show to be excellent selective coal flocculants for coal refuse slurry.

Having thus described our invention, it is claimed as follows:

1. A process for flocculating a coal refuse slurry with a water soluble polymeric flocculant to separate gangue from the coal, the improvement which comprises using as the flocculant a copolymer containing from 1–40 mole percent of 3-acrylamido-3-methyl butanoic acid with acrylamide or acrylic acid wherein the copolymers have an RSV measured as a 0.045 weight % copolymer solution in a 0.1M sodium nitrate solution of at least 15 dl/g.

2. The process of claim 1 wherein the 3-acrylamido-3-methylbutanoic acid copolymer is an acrylamide copolymer containing from 10–30 mole percent of the 3-acrylamido-3-methylbutanoic acid and has an RSV of at least 20 dl/g.

3. The process of claim 1 where the 3-acrylamido-3-methylbutanoic acid copolymer is an acrylic acid copolymer containing from 10–30 mole percent of the 3-acrylamido-3-methylbutanoic acid and has an RSV between 20–35 dl/g.

4. The process of claim 1 where the 3-acrylamido-3-methylbutanoic acid copolymer is an acrylamide copolymer further containing from between 5–50 mole percent of dimethylacrylamide.

* * * * *